US005159149A

United States Patent [19]

Marsden

[11] Patent Number: 5,159,149

[45] Date of Patent: Oct. 27, 1992

[54] ELECTRONIC DEVICE

[75] Inventor: Mark Marsden, Johannesburg, South Africa

[73] Assignee: Plessey South Africa Limited, Cape Province, South Africa

[21] Appl. No.: 724,492

[22] Filed: Jun. 24, 1991

Related U.S. Application Data

[63] Continuation of Ser. No. 385,220, Jul. 25, 1989, abandoned.

[30] Foreign Application Priority Data

Jul. 26, 1988 [ZA] South Africa ..... 88/5446

[51] Int. Cl.[5] ..... F42D 1/055

[52] U.S. Cl. ..... 102/217; 102/311; 102/207

[58] Field of Search ..... 102/217, 206, 200, 311, 102/312, 207

[56] References Cited

U.S. PATENT DOCUMENTS

| | | | |
|---|---|---|---|
| 3,170,399 | 2/1965 | Hinman, Jr. | 102/19.2 |
| 3,675,578 | 7/1972 | Douglas et al. | 102/206 |
| 3,750,586 | 8/1973 | Swallow et al. | 102/206 |
| 3,834,310 | 9/1974 | Ueda et al. | 102/22 |
| 4,615,268 | 10/1986 | Nakano et al. | 102/217 |
| 4,685,396 | 8/1987 | Birse et al. | 102/206 |
| 4,777,880 | 10/1988 | Beattie et al. | 102/312 |
| 4,802,414 | 2/1989 | Fiedler et al. | 102/206 |

FOREIGN PATENT DOCUMENTS

| | | | |
|---|---|---|---|
| 677326 | 12/1963 | Canada | 102/200 |

*Primary Examiner*—Stephen M. Johnson

*Attorney, Agent, or Firm*—Merchant & Gould, Smith, Edell, Welter & Schmidt

[57] ABSTRACT

An electronic detonator system 10 comprises a remote RF transmitter 11 and a transportable housing 12 comprising means 13 for charging energy storage means in the detonator 15 and means 14 for programming delay time means in the detonator. The programming means 14 and charging means 13 are connected to a connector 26. Detonator 15 comprises an antenna 29, a RF receiver 30, programmable delay time means 32, a switch 33, a fuse 34 and energy storage means 35. The delay time means 32 and energy storage means 35 are connected to a connector 28. In use, connector 26 is connected to connector 28 at the blast site and storage device 35 is charged and delay time means 32 is programmed. A fire command signal is then transmitted by transmitter 11 and after the delay time, switch 33 connects storage means 35 to fuse 34 thereby to energize the fuse.

12 Claims, 1 Drawing Sheet

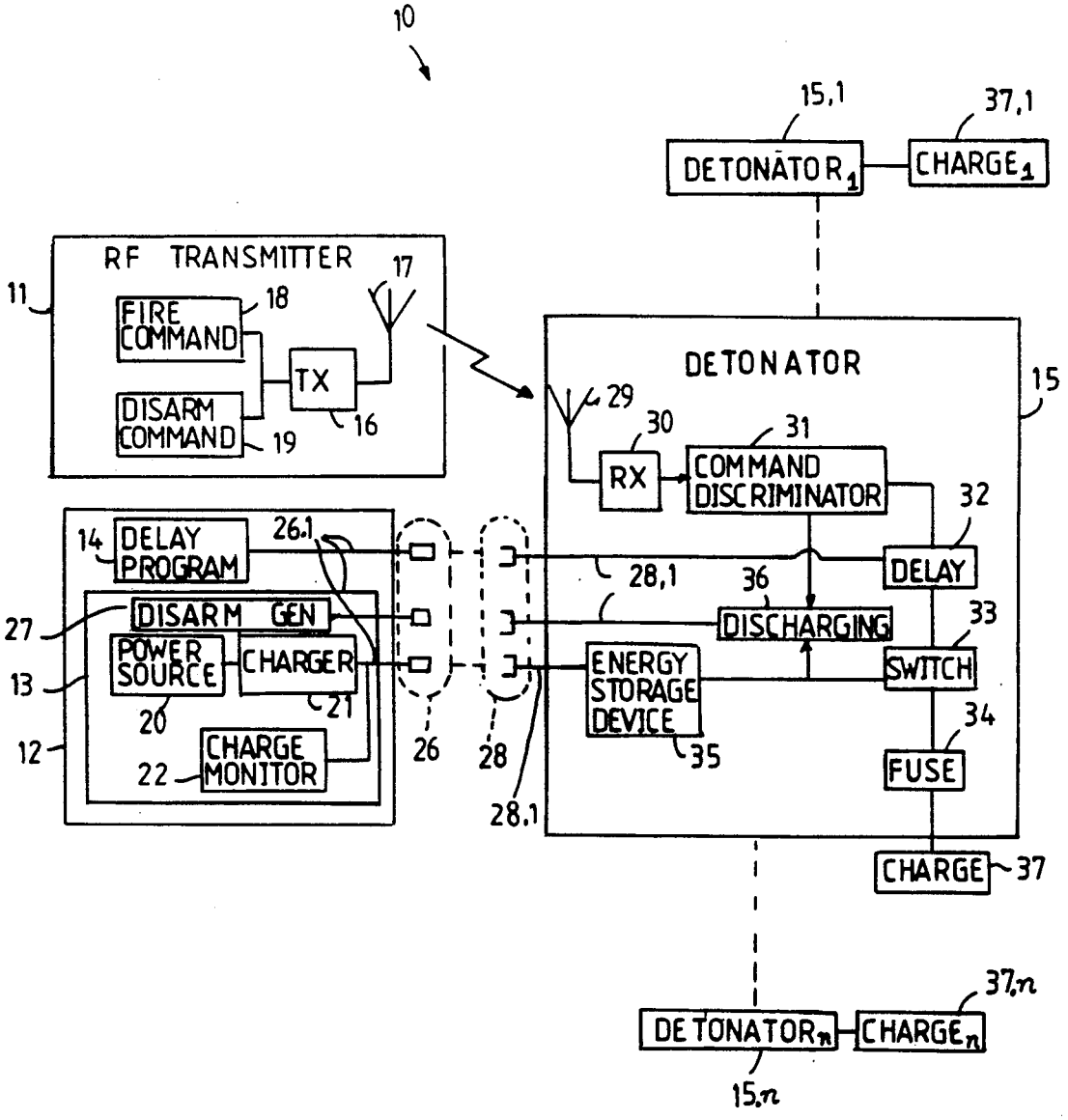
10
15,1
37,1
DETONATOR1
CHARGE1
RF TRANSMITTER
17
11
FIRE COMMAND
18
TX
DISARM COMMAND
19
16
DETONATOR
15
29
30
31
RX
COMMAND DISCRIMINATOR
32
14
DELAY PROGRAM
26,1
28,1
36
DELAY
27
DISARM GEN
DISCHARGING
33
POWER SOURCE
CHARGER
SWITCH
13
21
ENERGY STORAGE DEVICE
20
34
12
CHARGE MONITOR
26
28
FUSE
22
35
28,1
CHARGE
37
37,n
DETONATORn
CHARGEn
15,n

ELECTRONIC DEVICE

This is a continuation of application Ser. No. 07/385,220 filed Jul. 25, 1989 now abandoned.

BACKGROUND OF THE INVENTION

1. Field of the Invention

This invention relates to a detonator for use in setting off an explosive charge, and to a method of setting off an explosive charge.

2. Background Information

Detonators are used extensively in mining and quarrying. In use, a detonator is arranged in close association with a primer. The detonator has a fuse which detonates the primer, the primer in turn causes the charge to explode. It is often desirable to set off a series of explosive charges sequentially, with accurate, split-second timing between explosions. An arrangement for effecting such sequential detonation is referred to as a sequential detonics train.

Existing detonators utilize either a cord which is ignited and burns, or a fuse wire which is ruptured by passing an electrical current therethrough. In the cord type of detonators, timing is determined by the length of the cord and the speed at which it burns. They have the disadvantage that timing can often not be controlled accurately enough and that a burning cord is not acceptable in certain environments such as, for example, in coal mines where there is the risk of gas explosions. In the fuse wire type of detonators, timing is usually provided by electronic means. A drawback of some known fuse wire type detonators is that they require long lengths of insulated, relatively heavy gauge copper wire running from the source of current that is used to rupture them. The wire is costly and the copper as well as the insulation ends up as impurities in the ore that is being mined, and as such is unwanted.

SUMMARY OF THE INVENTION

It is an object of the present invention to provide a detonator, a detonator system and a method of detonating an explosive charge with which the applicant believes the aforementioned disadvantages will at least be alleviated.

According to the invention an electronic detonator comprises:

fuse means;

energy storage means and first connector means connected to the energy storage means, the first connector means being disconnectably connectable to separate means for charging the energy storage means so that when connected, a dedicated path for charging the storage means is provided to extend between the charging means and the storage means.

a receiver for receiving a radiated electromagnetic fire command signal transmitted by a remote transmitter; and switch means which is responsive to the receiver and operable to connect the energy storage means to the fuse means, after reception of the fire command signal, thereby to energize the fuse means.

The detonator may also comprise variable delay time means for providing a delay time between reception of the fire command signal and operation of the switch means.

The delay time means may be connected to second connector means, the second connector means being disconnectably connectable to separate delay time programming means so that when connected, a dedicated data path for programming the delay time means by loading delay time data from the programming means into the delay time means is provided to extend between the programming means and the delay time means.

The first and second connector means preferably are ganged to form a single connector.

In one embodiment one or more electrical conductors connecting the energy storage means and the delay time means to the connector may be used as an antenna for the receiver.

The detonator may also comprise a command discriminator connected to an output of the receiver; and discharging means connected to the energy storage means, the command discriminator being adapted to distinguish fire command and disarm command signals and upon reception of a disarm command signal to cause the discharging means to discharge the energy storage means thereby to disarm the detonator.

Also included within the scope of the present invention is a detonator system comprising an electronic detonator; the detonator including fuse means, energy storage means connected to first connector means, a receiver for receiving a radiated electro-magnetic fire command signal, switch means which is responsive to the receiver and operable after reception of the fire command signal to connect the energy storage means to the fuse means thereby to energize the fuse means; and separate means for charging the energy storage means disconnectably connectable to the first connector means so that when connected, a dedicated path for charging the storage means is provided to extend between the charging means and the storage means.

The detonator of the primer system preferably also comprises delay time means for providing a delay time between reception of the fire command signal and operation of the switch means and second connector means connected to the delay time means. The system preferably also comprises delay time programming means separate from the detonator and which is disconnectably connectable to the second connector means so that when connected a dedicated data path for programming the delay time means is provided to extend between the programming means and the delay time means.

The charging means and delay time programming means may be housed in a single transportable housing with the charging means and programming means being connected to third and fourth connector means respectively, the third and fourth connector means being disconnectably connectable to the aforementioned first and second connector means respectively.

In the preferred embodiment the detonator system comprises a transmitter for transmitting the electromagnetic fire command signal from a remote control station.

Also included within the scope of the present invention is a method of detonating an explosvie charge located at a blast site from a remote control station by means of a detonator system, the detonator system comprising a detonator including fuse means, energy storage means, a receiver for reception of a radiated electromagnetic fire command signal; a separate transmitter; and separate means for charging the energy storage means, the method comprising the steps of:

positioning the detonator at the blast site adjacent the charge;

connecting at the blast site the charging means to the energy storage means to provide a dedicated path extending between the charging means and storage means for charging the storage means;

charging the storage means;

disconnecting the charging means;

evacuating the blast site;

transmitting from the remote control station a fire command signal;

receiving the fire command signal at the receiver; and causing the energy storage means to energize the fuse means after reception of the fire command signal thereby to cause the charge to explode.

In its preferred form and before the fire command signal is transmitted, the method comprises the steps of: connecting at the blast site separate delay time programming means to programmable delay time means in the detonator thereby to provide a dedicated data path extending between the programming means and the delay time means, programming the delay time means by loading delay time data from the programming means into the delay time means, and disconnecting the programming means. The storage means is then caused to energize the fuse means the programmed delay time after reception of the fire command signal.

The method according to the invention also extends to a method wherein a plurality of charges are detonated in time delay sequency by loading and storing data regarding a longer delay time into each following detonator in a sequence of detonators.

DETAILED DESCRIPTION OF THE PREFERRED EMBODIMENT

The invention will now further be described, by way of example only, with reference to the accompanying drawing which shows a block diagram of a detonator system in accordance with the invention.

Referring to the diagram, the detonator system is generally designated by the reference numeral 10. The system 10 comprises a remote, electromagnetic wave transmitter in the form of a radio frequency RF transmitter 11, a plurality of identical detonator 15.1 to 15.n, only one of which is shown in more detail and designated by the reference numeral 15 and a transportable housing 12 comprising means 13 for charging energy storage means in the detonator and means 14 for programming programmable delay time means in the detonator.

The transmitter 11 comprises a low-power RF source 16, an antenna 17, a fire command generator 18 and a disarm command generator 19.

The charging means 13 comprises an electric power source 20, a charger 21 and a charge monitor 22. The charger 21, charge monitor 22 and delay time programming means 14 are connected via electric conductors 26.1 to a plug-in connector 26. The charging means 13 also comprises disarm command generating means 27 connected to connector 26.

Detonator 15, which is similar to the other detonator, comprises a plug-in connector 28 which is complementary to the aforementioned plug-in connector 26, a receiving antenna 29, a radio frequency receiver 30, a command discriminator 31 connected to an output of the receiver, a programmable delay time circuit 32, a switch 33, a fuse 34, an energy storage device 35 and discharging means 36. The discharging means is connected to plug-in connector 28 and to discriminator 31.

If desired, one or more of conductors 28.1 connecting connector 28 to the rest of the detonator circuitry may form the antenna 29.

In use, detonators 15.1 to 15.n are installed at the blast site by affixing them to primers (not shown) which are arranged to set off main explosive charges 37.1 to 37.n.

At the blast site the plug-in connector 26 and that 28 of a selected detonator 15 are interconnected to form a dedicated path between the charger 21 and the storage device 35 of the selected detonator. The energy storage device 35 is charged from power source 20 via the said path until fully charged. By making use of the delay programming means 14 and the dedicated data path between the programming unit 14 and the programmable delay time circuit 32 of the selected detonator, the delay time circuit is programmed by loading delay time data into the delay time circuit to provide a predetermined delay time between detection by the command discriminator 31 of a fire command signal and switching on of the switch 33 to connect the storage means 35 to fuse 34.

While connectors 26 and 28 are so connected, disarm command generator means 27 in charging means 13 may be used to discharge storage device 35 through discharging means 36 thereby to disarm the detonator 15, if necessary.

After the storage device 35 of the selected primer 15 has been charged and its delay time circuit 32 has been programmed, the connectors 26 and 28 are disconnected.

The procedure described above is repeated for all the other detonators 15.1 to 15.n, each being programmed by means of the delay time programming device 14. If a sequential detonics train is required, a slightly different delay time is programmed into each of the primers. Having completed this, the operator responsible for the hereinbefore described charging and programming actions, evacuates the blast site.

When it is desired to set off the explosive charges 37.1 to 37.n the fire command generator 18 is activated. This causes a fire command signal to be transmitted by wireless transmission to all the detonators 15.1 to 15.n simultaneously.

Although reference is made only to detonator 15, the hereinafter described events take place in all the detonators. The fire command signal is received via antenna 29 and receiver 30 and analysed by command discriminator 31. Upon detection of the fire command signal, the delay circuit 32 is triggered and, at the end of the delay time to which it has been programmed, it causes the switch 33 to close. Closure of the switch 33 connects the energy storage device 35 to the fuse 34, rupturing the fuse, detonating the primer, and setting off the main explosive charge.

The detonators 15.1 to 15.n can also be disarmed by remote control, after the connectors 26 and 28 have been disconnected. This takes place by activating the disarm command generator 19, which causes a disarm command signal to be transmitted by wireless transmission to all the detonators 15.1 to 15.n simultaneously. The disarm command signal is detected by the command discriminator 31, which in turn causes the discharging means 36 to discharge the energy storage means 35.

It will be appreciated that there are many variations in detail possible on the primer, the detonator system and the method according to the invention without departing from the scope and spirit of the appended claims.

I claim:

1. An electronic detonator for use in a detonator system comprising the detonator, a remote transmitter and external means comprising electrical energy charging means and delay time programming means, the detonator comprising:

fuse means;

connector means for disconnectably connecting the detonator to said external means so that when connected a physical connection is established exclusively between the external means and the detonator;

energy storage means disconnectably connected to said charging means of said external means via the physical connection so that the storage means may be charged by the charging means via the physical connection;

switch means operable selectively to connect the storage means to the fuse means;

a receiver for receiving a radiated electromagnetic fire command signal transmitted by said remote transmitter;

variable delay time means for providing a delay time between reception of the fire command signal and operation of the switch means, said variable delay time means including first and second inputs and an output;

the first input of the variable delay time means being disconnectably connectable to the delay time programming means via the physical connection so that the delay time means may be programmed by loading delay time data from the programming means into the delay time means via the physical connection;

the second input of the variable delay time means being connected to the receiver so that the receiver may activate the delay time means; and the output of the variable delay time means being connected to the switch means to connect the energy storage means to the fuse means, the programmed delay time after reception of the fire command signal, thereby to energize the fuse means.

2. A detonator as claimed in claim 1 wherein the connector means comprises a first connector and a second connector, the first connector being connected to the energy storage means of the detonator and being disconnectably connectable to the electrical energy charging means of the external means and the second connector being connected to the first input of the delay time means and being disconnectably connectable to the delay time programming means.

3. A detonator as claimed in claim 2 wherein the first and second connectors are ganged to form a single connector.

4. A detonator as claimed in claim 1 comprising a command discriminator connected to an output of the receiver; and discharging means connected to the energy storage means, the command discriminator being adapted to distinguish transmitted fire and disarm command signals and upon reception of the disarm command signal to cause the energy storage means to be discharged through the discharging means.

5. A detonator as claimed in claim 4 wherein the discharging means is disconnectably connectable via the physical connection to an external discharge command generator forming part of the external means so that a discharge command signal may be communicated to the discharging means via the physical connection, thereby to discharge the energy storage means through the discharging means.

6. A detonator system comprising:

at least one electronic detonator; each detonator comprising:

fuse means;

energy storage means selectively electrically connectable to the fuse means;

a receiver for receiving a radiated electromagnetic fire command signal;

switch means which is responsive to the receiver and operable to connect the energy storage means to the fuse means after reception of the fire command signal thereby to energize the fuse means;

programmable delay time means for providing a predetermined delay time between reception of the fire command signal and operation of the switch means;

means external of the at least one electronic detonator disconnectably connectable to a selected detonator so that when connected, a physical connection is established exclusively between the external means and the selected detonator;

the external means comprising:

charging means for charging the energy storage means of the selected detonator so that the energy storage means of the selected detonator is chargeable via the connection;

delay time programming means which is disconnectably connectable to the delay time means of the selected detonator via the connection so that the delay time means of the selected detonator may be programmed by loading delay time data from the programming means into the delay time means of the selected detonator via the connection.

7. A detonator system as claimed in claim 6 wherein the charging means for charging the energy storage means and the delay time programming means are housed in a single transportable housing.

8. A detonator system as claimed in claim 7 wherein the energy storage means is connected to a first connector, the delay time means to a second connector, the external charging means to a third connector and the delay time programming means to a fourth connector and wherein the physical connection is established by connecting the first and second connectors to the third and fourth connectors, respectively.

9. A detonator system as claimed in claim 6 comprising a transmitter external of the at least one detonator for transmitting the electromagnetic fire command signal.

10. A method of detonating explosive charges located at a blast site from a remote control station by means of a detonator system, the detonator system comprising at least one detonator; each detonator including fuse means, energy storage means and a receiver for reception of a radiated electromagnetic fire command signal; the system further comprising a transmitter external of the at least one detonator; and charging means external of the at least one detonator for charging the energy storage means; the method comprising the steps of:

positioning a detonator at the blast site adjacent an explosive charge;

connecting at the blast site the charging means to the energy storage means of the positioned detonator to provide a physical connection extending between the charging means and said energy storage means, for charging the storage means;

charging the storage means;

disconnecting the charging means;

evacuating the blast site;

transmitting from the remote control station by means of the external transmitter a fire command signal;

receiving the fire command signal at the receiver of the positioned detonator; and causing the energy storage means of the positioned detonator to energize the fuse means of said detonator after reception of the fire command signal thereby to cause the charge to explode.

11. A method as claimed in claim 10 wherein, before the fire command signal is transmitted, there are included the steps of: connecting external delay time programming means to programmable delay time means in the detonator, programming the delay time means by loading delay time data from the programming means into the delay time means, and disconnecting the programming means; and wherein the energy storage means is caused to energize the fuse means the programmed delay time after reception of the fire command signal.

12. A method as claimed in claim 11 wherein the method further comprises:

positioning a detonator adjacent each of a plurality of spaced explosive charges;

charging the storage means of each of the detonators; and programming the delay time means of each of the detonators to detonate the spaced charges in time delay sequence.

* * * * *

UNITED STATES PATENT AND TRADEMARK OFFICE

CERTIFICATE OF CORRECTION

PATENT NO. : 5,159,149

DATED : October 27, 1992

INVENTOR(S) : Mark Marsden

It is certified that error appears in the above-identified patent and that said Letters Patent is hereby corrected as shown below:

Column 2, line 37, "primer" should read --detonator--

Column 3, line 43, "detonator" should read --detonators--

Column 3, line 60, "detonator" should read --detonators--

Column 4, line 67, "primer" should read --detonator--

Signed and Sealed this

Eleventh Day of January, 1994

*Attest:*

Bruce Lehman

BRUCE LEHMAN

*Attesting Officer*

*Commissioner of Patents and Trademarks*